US005859376A

United States Patent [19]

Ishibashi et al.

[11] Patent Number: 5,859,376

[45] Date of Patent: Jan. 12, 1999

[54] IRON BASE SINTERED ALLOY WITH HARD PARTICLE DISPERSION AND METHOD FOR PRODUCING SAME

[75] Inventors: Akiyoshi Ishibashi, Kumagaya; Tomonori Miyazawa, Ebina; Kunio Maki; Akira Fujiki, both of Yokohama, all of Japan

[73] Assignees: Nissan Motor Co., Ltd.; Riken Corporation, both of Japan

[21] Appl. No.: 787,232

[22] Filed: Jan. 22, 1997

[51] Int. Cl.[6] ..... C22C 33/02; B22F 3/12

[52] U.S. Cl. ..... 75/243; 75/246; 419/14; 419/29

[58] Field of Search ..... 75/240, 246, 243; 419/14, 29, 11

[56] References Cited

U.S. PATENT DOCUMENTS

| | | | |
|---|---|---|---|
| 4,080,205 | 3/1978 | Niimi et al. | 75/241 |
| 4,274,876 | 6/1981 | Kodama et al. | 75/243 |
| 4,505,988 | 3/1985 | Urano et al. | 428/569 |
| 4,836,848 | 6/1989 | Mayama et al. | 75/231 |
| 4,915,735 | 4/1990 | Motooka | 75/231 |
| 5,080,713 | 1/1992 | Ishibashi et al. | 75/246 |

FOREIGN PATENT DOCUMENTS

| | | |
|---|---|---|
| 55-148748 | 11/1980 | Japan . |
| 6415349 | 1/1989 | Japan . |

*Primary Examiner*—Ngoclan Mai
*Attorney, Agent, or Firm*—Bachman & LaPointe, P.C.

[57] ABSTRACT

An iron base sintered alloy with dispersed hard particles is provided which comprises by weight 3 to 15% nickel (Ni), 0.5 to 5% chromium (Cr), 0.5 to 2.0% carbon (C), the remainder iron (Fe) and unavoidable impurities. At least a part of nickel (Ni), molybdenum (Mo) and chromium (Cr) is contained in solid solution of an iron base matrix. At least a part of molybdenum (Mo) and chromium (Cr) is dispersed within the iron base matrix to form fine carbides or intermetallic compounds thereof. Uniformly dispersed within the iron base matrix are hard particles of 3 to 20% contain 50 to 57% chromium (Cr), 18 to 22% molybdenum (Mo), 8 to 12% cobalt (Co), 0.1 to 1.4% carbon (C), 0.8 to 1.3% silicon (Si) and the remainder iron (Fe) to strengthen the dispersion and remarkably improve wear resistance.

8 Claims, 1 Drawing Sheet

IRON BASE SINTERED ALLOY WITH HARD PARTICLE DISPERSION AND METHOD FOR PRODUCING SAME

FIELD OF THE INVENTION

This invention relates to iron base sintered alloys, in particular to wear resistant iron base sintered metals with dispersed hard particles suitable to manufacture of valve seats for high power automobile engines.

PRIOR ART

With progress of automobile engines designed for high power and for use of pollution-free clean fuel such as LPG, LNG and the like, valve seats of automobile engines tend to be subjected to further severer thermal and mechanical loads.

To cope with the increase of thermal and mechanical loads, the valve seats of automobile engines have been formed of metallic materials highly strengthened by consolidation to high alloys, forging and copper infiltration. For instance, chromium (Cr), cobalt (Co) and tungsten (W), when added to the material ingredients of iron base sintered metals, are effective to increase the strength of iron alloys at an elevated temperature against increase of the thermal load, and copper (Cu) is also indirectly effective to improve the thermal conductivity by infiltration. On the one hand, highly strengthen materials by high pressure forming, powder forging, cold forging, high temperature sintering or the like, are effective to endure increased mechanical loads.

As disclosed in Japanese Patent Disclosure No. 15349/1989, the inventors have proposed wear resistant iron base sintered alloys which are fabricated by dispersing hard particles in base metals of iron (Fe)-nickel (Ni)-carbon (C) group. However, in recent years, engines are subjected to such higher load that even such sintered alloys cannot resist.

Accordingly, it is an object of the present invention to provide a wear resistant iron base sintered alloy with dispersed hard particles and a method for producing same suitable to mechanical materials, such as valve seats for high power automobile engines to which large mechanical load is given at an elevated temperature.

BRIEF DESCRIPTION OF THE INVENTION

The iron base sintered alloy with dispersed hard particles according to the present invention comprises by weight, 3 to 15% nickel (Ni), 3 to 15% molybdenum (Mo), 0.5 to 5% chromium (Cr), 0.5 to 2% carbon (C) and the remainder of iron (Fe) with unavoidable impurities. At least a part of the nickel (Ni), molybdenum (Mo) and chromium (Cr) is contained in solid solution of an iron base matrix. At least a part of the molybdenum (Mo) and chromium (Cr) is dispersed within the iron base matrix to form fine carbides or intermetallic compounds thereof. Hard particles of 3 to 20% are uniformly dispersed within the iron base matrix. In a first embodiment of the present invention, the hard particles contain 50 to 57% chromium (Cr), 18 to 22% molybdenum (Mo), 8 to 12% cobalt (Co), 0.1 to 1.4% carbon (C), 0.8 to 1.3% silicon (Si) and the remainder iron (Fe). In the specification, the percentage is represented by weight base.

In a second embodiment of the invention, the hard particles may contain 27 to 33% chromium (Cr), 22 to 28% tungsten (W), 8 to 12% cobalt (Co), 1.7 to 2.3% carbon (C), 1.0 to 2.0% silicon (Si), and the remainder iron (Fe).

In a third embodiment o)f the invention, the hard particles may contain 60 to 70% molybdenum (Mo), carbon (C) less than 0.01%, and the remainder iron (Fe).

In a fourth embodiment of the invention, the hard particles are given by a mixture of at least two selected from three kinds of the following hard particles, each containing:

(1) 50 to 57% chromium (Cr), 18 to 22% molybdenum (Mo), 8 to 12% cobalt (Co), 0.1 to 1.4% carbon (C), 0.8 to 1.3% silicon (Si) and the remainder iron (Fe);

(2) 27 to 33% chromium (Cr), 22 to 28% tungsten (W), 8 to 12% cobalt (Co), 1.7 to 2.3% carbon (C), 1.0 to 2.0% silicon (Si) and the remainder iron (Fe); and (3) 60 to 70% molybdenum (Mo), carbon (C) less than 0.01% and the remainder iron (Fe).

The method for producing an iron base sintered alloy with dispersed hard particles according to the present invention, comprises the steps of: mixing carbonyl nickel (Ni) powder, metallic molybdenum (Mo) powder, graphite powder, and molybdenum iron (FeMo) with iron powder containing molybdenum (Mo) and chromium (Cr) to prepare raw material powder consisting by weight of 3 to 15% nickel (Ni), 3 to 15% molybdenum (Mo), 0.5 to 5% chromium (Cr), 0.5 to 2% carbon (C), the remainder iron (Fe) and unavoidable impurities; preparing 3 to 20% hard particles by one selected from the following three kinds of hard particles, each containing or by mixing at least two selected from three kinds of the following hard particles, each containing:

(1) 50 to 57% chromium (Cr), 18 to 22% molybdenum (Mo), 8 to 12% cobalt (Co), 1.0 to 1.4% carbon (C), 0.8 to 1.3% silicon (Si), and the remainder iron (Fe);

(2) 27 to 33% chromium (Cr), 22 to 28% tungsten (W), 8 to 12% cobalt (Co), 1.7 to 2.3% carbon (C), 1.0 to 2.0% silicon (Si), and the remainder iron (Fe); and (3) 60 to 70% molybdenum (Mo), carbon (C) less than 0.01%, and the remainder iron (Fe); adding the hard particles and zinc stearate to the raw material powder to make mixed powder; pressing the resultant mixed powder into a shape, heating for dewaxing, and sintering and cooling the shape; and further annealing the shape. The iron powder containing the molybdenum (Mo) and the chromium (Cr) has its grain size from 75 to 106 micrometers. The particle size of the carbonyl nickel (Ni) powder is under 45 micrometers. The molybdenum iron (FeMo) has its particle size from 75 to 106 micrometers. This method of may further comprises heating the shape for dewaxing; sintering and cooling the shape up to 900° C. in a furnace; cooling in gas and annealing the shape.

The iron base sintered alloys of the hard particle dispersion type according to the present invention, comprises by weight 3 to 15% nickel (Ni), 3 to 15% molybdenum (Mo), 0.5 to 5% chromium (Cr), 0.5 to 2.0% carbon (C), and other unavoidable impurities, besides iron (Fe). These nickel (Ni), molybdenum (Mo) and chromium (Cr), thus blended at the high concentration are dissolved in solid metallic crystal lattice of the iron base matrix, and molybdenum (Mo) and chromium (Cr) forms their fine dispersed carbides or intermetallic compounds dispersed in the matrix.

For instance, in the standard steel structure mainly containing ferrite and cementite, nickel (Ni), molybdenum (Mo) and chromium (Cr) are dissolved in solid ferrite or cementite to form carbides and bond cementites in order to produce non-metallic inclusions or intermetallic compounds, or exist alone in the metallic structure.

To generate 3 to 20% hard particles uniformly dispersed in the iron base matrix, it is possible to use for mixing one alone or at least two of three kinds of the following particles (1) to (3):

(1) 50 to 57% chromium (Cr), 18 to 22% molybdenum (Mo), 8 to 12% cobalt (Co), 0.1 to 1.4% carbon (C), 0.8 to 1.3% silicon (Si) and the remainder iron (Fe);

(2) 27 to 33% chromium (Cr), 22 to 28% tungsten (W), 8 to 12% cobalt (Co), 1.7 to 2.3% carbon (C), 1.0 to 2.0% silicon (Si) and the remainder iron (Fe); and (3) 60 to 70% molybdenum (Mo), carbon (C) less than 0.01% and the remainder iron (Fe).

Nickel (Ni) is preferably added in a range of 3 to 15%. Less than 3% of the added amount of nickel (Ni) is insufficient to improve the wear resistance of the sintered alloys, and the added amount of nickel over 15% causes to produce austenite which would provide difficult machinability for the sintered alloys. In addition, more than 15% of the added amount of nickel increases thermal expansion of the alloys so that the resultant valve seats disadvantageously tend to easily fall off. Therefore, nickel (Ni) needs to be in 3 to 15%.

Desirably, molybdenum (Mo) is added in a range of 3 to 15%. Less than 3% of the added molybdenum (Mo) result in the insufficient improvement in wear resistance of the alloys. With more than 15% of the added molybdenum (Mo), the alloys will contain an excessive amount of carbides which makes pressing of the powder and machining of products difficult, and also the alloys become brittle.

The added amount of chromium (Cr) should be in 0.5 to 5%. When it is less than 0.5%, the alloys will not indicate sufficient improvement in the oxidation resistance and wear resistance. The addition of chromium (Cr) over 5% results in the increased amount of carbides in the alloys which makes pressing of the powder and machining of the products difficult, and also the alloys become brittle. In another aspect, it is necessary to use powder of iron (Fe)- molybdenum (Mo)- chromium (Cr) group or iron (Fe)- molybdenum (Mo)- nickel (Ni) group containing molybdenum (Mo) and chromium (Cr) in order to uniformly solve and/or dissolve chromium in the solid iron base matrix. However, alloying at the high concentration of molybdenum (Mo), chromium (Cr) and nickel (Ni) in the iron powder, deteriorates machinability and workability of the hardened alloys. In this view, the particulate mixture should preferably contain at least a part of nickel (Ni) and molybdenum (Mo) in fine pure metallic powder of particle size less than 45 micrometers.

It should be noted that addition of chromium (Cr) in the form of metallic chromium produces solid carbides by reaction with carbon (C). Disadvantageously, these solid carbides have their bad sintering and adhesive property with the iron base matrix, increasing the attack property against mating valves so that chromium (Cr) is to previously be solved and/or dissolved in the solid iron powder of the main raw materials.

Carbon (C) should be added in 0.5 to 2% to the alloys. With less than 0.5% of carbon (C), the alloys produce its structure which contains ferrite (alpha solid solution) decreasing the wear resistance. Addition of carbon (C) over 2% produces excessive amount of martensite and carbides which causes lowered machinability and workability and brittleness of the alloys. In either case, the carbon (C) content is relatively determined depending on each amount of nickel (Ni), chromium (Cr) and molybdenum (Mo), and also depending on kinds and amount of hard particles in a range to prevent production of ferrite, martensite and carbides.

Available hard particles include one alone or more than two composite materials selected from three groups of: chromium - molybdenum - cobalt (Cr—Mo—Co) group alloys that comprises 50 to 57% chromium (Cr), 18 to 22% molybdenum (Mo), 8 to 12% cobalt (Co), 0.1 to 1.4% carbon (C), 0.8 to 1.3% silicon (Si), the remainder iron, and unavoidable impurities; chromium - tungsten - cobalt (Cr—W—Co) group alloys consisting of 27 to 33% chromium (Cr), 22 to 28% tungsten (W), 8 to 12% cobalt (Co), 1.7 to 2.3% carbon (C), 1.0 to 2.0% silicon (Si), the remainder iron, and impurities; and molybdenum - iron (Mo—Fe) group alloys consisting of 60 to 70% molybdenum (Mo), carbon (C) less than 0.01%, the remainder iron and unavoidable impurities.

The hard particles bring about action to disperse into and strengthen the metallic structure of the alloys. Also, when sintered, alloy elements are diffused from the hard particles to form high alloy phases around the hard particles to remarkably improve the wear resistance by the high alloy phases. The hard particles preferably are added in a range of 3 to 20%. With less than 3% of the added hard particles, the alloys do not show sufficient improvement in the wear resistance. If it exceeds 20%, wear resistance cannot be improved in proportion to increase in the added amount of hard particles, rather it will result in higher cost in preparing the alloys. Moreover, the excessive amount of the added hard particles gives the alloys brittleness, deteriorating the mechanical strength and workability of the alloys and tending to increase wear of mating valves. Accordingly, from these all viewpoints, surplus amount of the hard particles should not be added to the raw powder.

Japanese Patent Disclosure No. 15349/1989 discloses iron base sintered metals of hard particle dispersion type for valve seats for high power automobile engines, however the present invention contains a novel concept over the disclosure of this Japanese reference because the instant invention is characterized by adding chromium (Cr) to an iron base matrix to cause alloying of chromium (Cr) in the iron base matrix along with molybdenum (Mo) for increase of heat resistance and oxidation resistance and also for improvement of wear resistance and mechanical strength by sintering at a high temperature.

BRIEF EXPLANATION OF THE DRAWING

A drawing illustrates preferred embodiments of the present invention, in which.

DETAILED DESCRIPTION OF THE EMBODIMENTS

Figure 1:
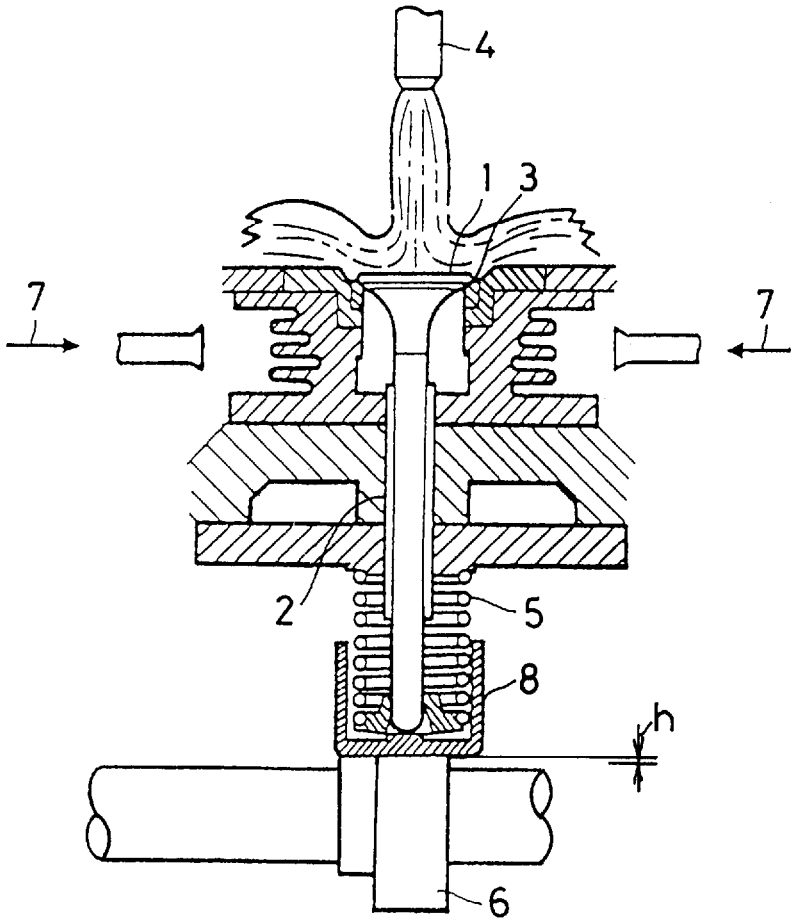
FIG. 1 is a sectional view of a beating wear testing machine.

The following is the description of worked modes of the present invention.

Blended with ferrous powder having its peak particle size of 75 to 106 micrometers and containing 4% molybdenum (Mo) and 1% chromium (Cr), were carbonyl nickel (Ni) powder under 45 micrometers, metallic molybdenum (Mo) powder, graphite powder and molybdenum iron (FeMo) having its particle sizes of 75 to 106 micrometers at the mixing ratio by weight of 7% carbonyl nickel, 2% metallic molybdenum (Mo) powder, 0.8% graphite powder and 10% molybdenum iron (FeMo) hard particle. Similarly, mixture were made with various different amounts of molybdenum (Mo) and chromium (Cr) and different amounts and kinds of the hard particles. Also, 0.5% zinc stearate as a lubricant was added to the mixture to give a better release property from a die to formed shapes. The resultant powdery mixture was pressed under a pressure of 7 tons per 1 $cm^2$ into shapes which were thereafter heated for an hour at a temperature of 650° C. for dewaxing, sintered for an hour at a temperature of 1230° C., and then cooled to 900° C. in vacuum furnace. Consequently, the sintered shapes were quenched by nitrogen ($N_2$) gas from 900° C. and then annealed at 650° C. to prepare samples of Nos. 7 to 9 shown in Table 1.

TABLE 1

Relationship between alloy components and wear resistance

| No. | Cr | Mo | Ni | C | Hard Particles | Clearance Change (micrometers) Seating Surface Test Temperature (°C.) | | | | |
|---|---|---|---|---|---|---|---|---|---|---|
| (%) | (%) | (%) | (%) | (%) | (%) | 100 | 200 | 300 | 400 | Sample |
| 1 | 0 | 0 | 7 | 0.9 | 10 | 320 | 220 | 110 | 230 | Comparative |
| 2 | 0 | 3 | 7 | 0.8 | 10 | 50 | 60 | 70 | 140 | Comparative |
| 3 | 0 | 10 | 7 | 1.0 | 10 | 50 | 40 | 70 | 170 | Comparative |
| 4 | 0 | 14 | 7 | 1.2 | 10 | 70 | 60 | 70 | 70 | Comparative |
| 5 | 3 | 0 | 7 | 1.1 | 10 | 170 | 50 | 40 | 70 | Comparative |
| 6 | 5 | 0 | 7 | 1.2 | 10 | 160 | 40 | 30 | 50 | Comparative |
| 7 | 1 | 4 | 7 | 0.8 | 10 | 60 | 50 | 50 | 80 | Invention |
| 8 | 3 | 4 | 7 | 1.1 | 10 | 70 | 50 | 50 | 60 | Invention |
| 9 | 5 | 15 | 7 | 1.3 | 10 | 90 | 60 | 60 | 110 | Invention |

Subsequently, heat treatment was performed at temperatures suitable to each metallic component to adjust hardness of the sintered alloys in HRB (Rockwell B Scale)=90 to 110 so that the alloys were machined to produce test samples of valve seats.

Comparative test samples of sintered valves shown by Nos. 1 to 6 were also prepared from prior art materials in a same shape and machined into given dimensions, and then each tested to evaluate wear and friction resistances of the valve seat materials. In view of the actual conditions applied to exhaust valve scats, measurement was taken under the condition of Valve material: Heat Resistant Steel SUH-36 under Japan Industrial Standards; Number of revolutions: 3000rpm; Test duration: 5 hours; Level of temperature condition: 4; Valve upper surface: at 450° C. to 700° C. ; Valve seat outer surface at 150° to 450°.

Test samples were attached to the beating wear testing machine as shown in FIG. 1, and each wear resistance of these samples was evaluated by measuring change in clearance length of the valves at the beginning and end of testing. The "change in the valve clearance length" means the increase h of clearance length between a tappet 8 and a cam 6. As shown in FIG. 1, an upper end of a valve 1 supported by a valve guide 2 is brought into contact with a valve seat insert 3 so that a flame is emitted downward on the valve 1 from a gas burner 4 positioned above the valve 1. Compressed cooling air 7 is supplied outside the valve seat insert 3. The valve 1 is always urged toward the cam 6 by elastic force of a valve spring 5 so that it may vertically be reciprocated upon rotation of a cam shaft formed with the cam 6.

As understood from Table 1, it is obvious that the valve seats of Nos. 7 to 9 according to the present invention have their improved wear resistance at an elevated temperature in comparison with prior art valve seats of Nos. 1 to 6. In Table 1, the hard particles include iron (Fe) - 63% molybdenum. In this case, the test samples that contain molybdenum alone show less wear at a lower temperature, but much wear at a higher temperature. On the contrary, the test samples that contain chromium (Cr) alone show much wear at a lower temperature, but less at a higher temperature.

Raw material of ferrous powder was prepared composed of iron (Fe) - 5% molybdenum (Mo) - X% chromium (Cr) - 0.4% carbon (C) wherein molybdenum (Mo) and chromium (Cr) were previously transformed into alloys. To adjust density of the mixed powder to 7.0g/cm3, carbon (C) was added to the iron powder, and the mixture was formed into round sticks of 15mm in diameter and 50mm in height. These round sticks were sintered for an hour at a temperature of 1230° C., and cooled in nitrogen gas to prepare test samples. The test samples were heated for 15 hours at 800° C. in atmosphere to thereby measure the weight increase of the test samples caused by the oxidization. Table 2 apparently indicates that the oxidization resistance is more improved with increase of added chromium (Cr).

TABLE 2

Relationship between chromium and oxidation resistance

| Cr (%) | 0 | 1 | 4 | 6 |
|---|---|---|---|---|
| Increase in weight by oxidation ($mg/cm^2$) | 300 | 240 | 169 | 91 |

Raw material powder of iron powder was prepared composed of iron (Fe) - 5% molybdenum (Mo) - X% chromium - 0.4% carbon (C) wherein molybdenum (Mo) and chromium (Cr) were previously transformed into alloys. 1% of zinc stearate as a lubricant was added to the iron powder and was formed into shapes under pressure of 6.5 tons per 1 $cm^2$ to thereby measure density of the shapes under the temperature condition of the aforementioned level 2. Table 3 demonstrates the decreased density with increase of the added amount of chromium (Cr) and molybdenum (Mo) and with worsened workability of the iron powder so that the higher forming pressure should be loaded on the iron powder to form the shapes of a desired density.

TABLE 3

Relationship between density of shape and chromium or molybdenum

| Chromium (Cr) % | 0 | 0 | 0 | 0 | 5 | 5 | 5 |
|---|---|---|---|---|---|---|---|
| Molybdenum (Mo) % | 0 | 5 | 10 | 15 | 3 | 10 | 15 |
| Density of shapes ($g/cm^3$) | 7.20 | 6.87 | 6.78 | 6.54 | 6.41 | 6.23 | 5.98 |

Table 4 indicates a relationship between wear resistance and added amount of the hard particles composed of chromium (Cr) - tungsten (W) - cobalt (Co). This Table reveals that the wear is decreased with increase of the added amount of the hard particles up to a certain content, however, adversely the wear is increased, when the added amount of the hard particles exceeds the certain content. Therefore, the appropriate added amount of the hard particles is in a range of 3 to 20%.

Tables 1 and 4 in the foregoing embodiment respectively exhibit two kinds of the hard particles of iron (Fe) - 63% molybdenum (Mo) group and Chromium (Cr) - tungsten (W) - cobalt (Co) group. In addition, the inventors tested three kinds of 3 to 20% hard particles of chromium - molybdenum - cobalt (Cr—Mo—Co) group alloys; chromium - tungsten - cobalt (Cr—W—Co) group alloys; and molybdenum - iron (Mo—Fe) group alloys throughout the all

TABLE 4

Relationship between amount of H.P.P. and wear resistance

| Cr (%) | Mo (%) | C (%) | H.P.P. (%) | Clearance Change (micrometers) | Sample |
|---|---|---|---|---|---|
| 1 | 4 | 0.8 | 0 | 110 | Comparative |
| 1 | 4 | 0.8 | 3 | 80 | Invention |
| 1 | 4 | 0.8 | 10 | 60 | Invention |
| 1 | 4 | 0.8 | 15 | 70 | Invention |
| 1 | 4 | 0.8 | 20 | 80 | Invention |
| 1 | 4 | 0.8 | 25 | 120 | Comparative |

composition ranges, and tested 3 to 15% nickel (Ni), 3 to 15% molybdenum (Mo) and 0.5 to 2% carbon (C) throughout the all composition ranges. As a result, it has been found that the iron base sintered alloys with hard particle dispersion indicate the better wear resistance all over the composition ranges in comparing the conventional alloys.

The aforementioned embodiment of the invention represents the examples prepared by sintering the shapes after dewaxing by heating, cooling down to 900° C., then cooling in gas and further annealing same. However, similar effects may be resulted by quenching and annealing after sintering in the same way as applied to ordinary steels subjected to water quenching after sintering.

As described above, the present invention can realize the iron base sintered alloys with hard particle dispersion that have their improved wear resistance for reliability in quality of the metallic products even when heavier load is applied to the alloys at an elevated temperature.

What is claimed is:

1. An alloy which comprises: an iron base sintered alloy with dispersed hard particles wherein said alloy comprises an iron base matrix and 3 to 20% hard particles uniformly dispersed within said iron base matrix; and wherein said iron base matrix comprises by weight, 3 to 15% nickel, 3 to 15% molybdenum, 0.5 to 5% chromium, 0.5 to 2% carbon and the remainder of iron with unavoidable impurities; and wherein at least a part of said nickel, molybdenum and chromium is contained in solid solution in the iron base matrix; and at least a part of said molybdenum and chromium is dispersed within the iron base matrix to form at least one of fine carbides and intermetallic compounds thereof.

2. An alloy according to claim 1, wherein said hard particles contain 50 to 57% chromium, 18 to 22% molybdenum, 8 to 12% cobalt, 0.1 to 1.4% carbon, 0.8 to 1.3% silicon and the remainder iron.

3. An alloy according to claim 1, wherein said hard particles contain 27 to 33% chromium, 22 to 28% tungsten, 8 to 12% cobalt, 1.7 to 2.3% carbon, 1.0 to 2.0% silicon, and the remainder iron.

4. An alloy according to claim 1, wherein said hard particles contain 60 to 70% molybdenum, carbon less than 0.01%, and the remainder iron, uniformly dispersed within the iron base matrix.

5. An alloy according to claim 1, wherein said hard particles contain a mixture of at least two selected from the following three kinds of hard particles:

(1) 50 to 57% chromium, 18 to 22% molybdenum, 8 to 12% cobalt, 0.1 to 1.4% carbon, 0.8 to 1.3% silicon and the remainder iron;

(2) 27 to 33% chromium, 22 to 28% tungsten, 8 to 12% cobalt, 1.7 to 2.3% carbon, 1.0 to 2.0% silicon and the remainder iron; and (3) 60 to 70% molybdenum, carbon less than 0.01% and the remainder iron.

6. A method for producing an iron base sintered alloy with dispersed hard particles comprising the steps of:

preparing iron powder which contains molybdenum and chromium;

mixing, with said iron powder material comprising carbonyl nickel powder, metallic molybdenum powder, graphite powder, and molybdenum iron to prepare raw material consisting by weight of 3 to 15% nickel (Ni), 3 to 15% molybdenum (Mo), 0.5 to 5% chromium (Cr), 0.5 to 2% carbon (C), the remainder iron (Fe) and unavoidable impurities;

preparing 3 to 20% hard particles selected from the following three kinds of hard particles, each containing at least two selected from the following three kinds of hard particles:

(1) 50 to 57% chromium, 18 to 22% molybdenum, 8 to 12% cobalt, 0.1 to 1.4% carbon, 0.8 to 1.3% silicon, and the remainder iron;

(2) 27 to 33% chromium, 22 to 28% tungsten, 8 to 12% cobalt, 1.7 to 2.3% carbon, 1.0 to 2.0% silicon, and the remainder iron; and (3) 60 to 70% molybdenum, carbon less than 0.01%, and the remainder iron;

adding the hard particles and zinc stearate to the raw material to make mixed powder;

pressing the resultant mixed powder into a shape, heating for dewaxing, and sintering and cooling the shape; and further annealing the shape;

whereby at least a part of said nickel, molybdenum and chromium is contained in solid solution of an iron base matrix; at least a part of said molybdenum and chromium is dispersed within the iron base matrix to form fine carbides or intermetallic compounds thereof; and said hard particles are uniformly dispersed within said iron base matrix.

7. A method for producing an iron base sintered alloy according to claim 6, wherein said iron powder containing the molybdenum and the chromium has its peak particle size from 75 to 106 micrometers; the particle size of said carbonyl nickel powder is under 45 micrometers; and said molybdenum iron has its peak particle size from 75 to 106 micrometers.

8. A method for producing an iron base sintered alloy defined in claim 6, further comprising: heating said shape for dewaxing; sintering and cooling said shape up to 900° C. in furnace; cooling in gas and annealing said shape.

* * * * *